US009835000B2

(12) United States Patent
Weddle

(10) Patent No.: US 9,835,000 B2
(45) Date of Patent: Dec. 5, 2017

(54) DOOR LATCH FOR POWER TONG

(71) Applicant: Eckel Manufacturing Co. Inc., Odessa, TX (US)

(72) Inventor: Dwayne Austin Weddle, Odessa, TX (US)

(73) Assignee: Eckel Manufacturing Co., Inc., Odessa, TX (US)

( * ) Notice: Subject to any disclaimer, the term of this patent is extended or adjusted under 35 U.S.C. 154(b) by 245 days.

(21) Appl. No.: 14/811,356

(22) Filed: Jul. 28, 2015

(65) Prior Publication Data

US 2017/0030153 A1 Feb. 2, 2017

(51) Int. Cl.
*E21B 19/16* (2006.01)

(52) U.S. Cl.
CPC ..... *E21B 19/161* (2013.01); *E21B 19/164* (2013.01)

(58) Field of Classification Search
CPC ..... E21B 19/161; E21B 19/164
See application file for complete search history.

(56) References Cited

U.S. PATENT DOCUMENTS 4,350,062 A * 9/1982 Farr ..... E21B 19/164 81/57.18
4,487,092 A * 12/1984 Neves ..... B23P 19/061 384/610
4,593,584 A * 6/1986 Neves ..... E21B 19/164 81/57.18
5,144,868 A * 9/1992 Feigel, Jr. ..... E21B 19/164 81/57.14
6,058,811 A 5/2000 Stuart
6,279,426 B1 * 8/2001 Neves ..... E21B 19/164 81/57.15
7,762,160 B2 * 7/2010 Basler ..... E21B 19/164 81/57.18
9,453,377 B2 * 9/2016 Mosing ..... E21B 19/165
2003/0177870 A1 9/2003 Neves
2015/0107850 A1 * 4/2015 Mosing ..... E21B 19/165 166/377

OTHER PUBLICATIONS

International Search Report and the Written Opinion of the International Searching Authority; (ISA) International Searching Authority; Oct. 17, 2016.

* cited by examiner

*Primary Examiner* — David B Thomas
(74) *Attorney, Agent, or Firm* — Patrick K. Steele

(57) ABSTRACT

A latch mechanism for securing a pivoting door of a power tong in a closed position across a lateral opening to an interior bay of the power tong includes a door cylinder coupled at a proximal end to the body and having an extendable rod to pivot the door between a closed position, across the lateral opening, and an open position providing lateral access to the interior bay, the power tong further includes a latch cylinder coupled at a proximal end to the door and having an extendable rod to pivot a latch member to pivot between an engaged position, to engage a latch post on the body, and a retracted position to disengage the latch post of the body.

8 Claims, 5 Drawing Sheets

DOOR LATCH FOR POWER TONG

BACKGROUND

Field of the Invention

The present invention relates to power tongs for making up threaded connections between adjacent pipe sections. More specifically, the present invention relates to an improved latch mechanism for securing a power tong door in the closed position.

Background of the Related Art

Conventional power tongs include a bay having a lateral access. The bay is closed using a power tong door that is hinged to the power tong body at a proximal end of the door and latchable to the power tong body at a position across the lateral access to the bay at a distal end of the door. This configuration enables the door to engage the power tong body in a manner that opposes spreading of the power tong body during operation.

Many power tong doors are manually secured in the latched position and manually opened to laterally receive or surrender a tubular joint. Some power tong doors are automatically closed across the lateral access, automatically latched in the closed position and automatically unlatched and opened after the power tong is used to make up or break out a threaded connection between two adjacent tubular joints.

BRIEF SUMMARY

One embodiment of the present invention provides a power tong body with a door and an improved latch mechanism for securing the door of the power tong in the closed position across an interior bay of the power tong body, the power tong comprising a body having the interior bay for receiving an end of a pipe segment, a lateral access opening providing lateral access to the interior bay, a latch post disposed on the body adjacent to a lateral access to the interior bay, a door having a proximal end pivotally coupled to the body and a distal end having at least one static latch member with a well in a static latch member to receive and engage the latch post on the power tong body upon closure of the door across the lateral access opening, the distal end of the door further including at least one pivoting latch member pivotally coupled to the door adjacent to the at least one static latch member, the pivoting latch member having a proximal end and a distal end with a keeper to receive and engage the latch post on the body, the pivoting latch member being pivotally positionable relative to the door between an engaged position, to engage the keeper at the distal end of the at least one pivotal latch member with the latch post to secure the door in a closed position across the lateral opening, and a retracted position to disengage the distal end of the pivotal latch member and the keeper from the latch post to release the door from the closed position, the power tong further including a door cylinder coupled to the body with an extendable rod extendably received in the door cylinder, the extendable rod having a distal end pivotally coupled to the door, the extendable rod being extendable from the door cylinder to move the door from an open position to a closed position to close the lateral access to the interior bay of the body and the extendable rod being retractable into the door cylinder to move the door from the closed position to the opened position removed from the lateral access opening to the interior bay of the body, and the power tong further including a latch cylinder having a proximal end pivotally coupled to the door and a rod extendable from the latch cylinder with a distal end of the extendable rod coupled to a proximal end of the at least one pivotal latch member, the latch cylinder being extendable to pivot the at least one pivotal latch member to the retracted position and retractable within the latch cylinder to pivot the at least one pivotal latch member to the engaged position wherein the latch post is received into the keeper of the pivotal latch member, wherein the at least one pivotal latch member, in the engaged position, secures the door in the closed position to close the bay of the power tong body by application of a force against the latch post of the body in opposition to a force imparted to the latch post by the at least one static latch member.

In a related embodiment of the power tong of the present invention, the door cylinder and the latch cylinder are each one of hydraulic cylinders and pneumatic cylinders. These types of cylinders can be generically referred to as fluid cylinders.

In a preferred embodiment of the power tong of the present invention, the at least one static latch member comprises two static latch members having a gap therebetween to engage the latch post at two spaced-apart positions, and the at least one pivotal latch member comprises one single pivotal latch member, wherein the one pivotal latch member engages the latch post at a position on the latch post that is aligned with the gap between the two static latch members and intermediate two positions on the latch post engaged by the two static latch members.

DETAILED DESCRIPTION

Figure 1:
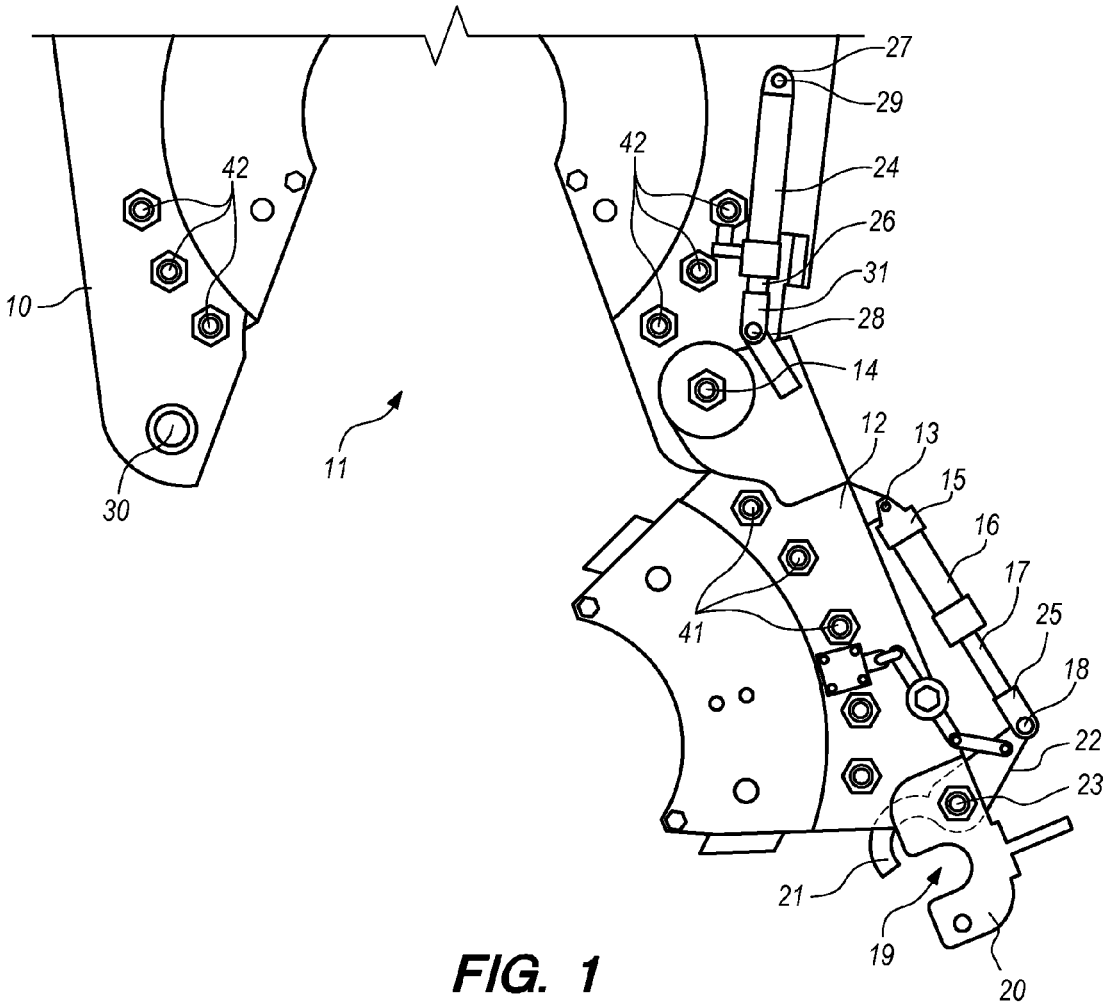
FIG. 1 is a plan view of a power tong body having a door equipped with an embodiment of an improved power tong door latch of the present invention in the open and unlatched position.

FIG. 1 is a plan view of a power tong body 10 having a door 12 equipped with an embodiment of an improved power tong door latch of the present invention in the open and unlatched position. The door 12 is pivotally coupled to the power tong 10 at pivot member 14 to enable the door 12 to pivot between the open position (shown in FIG. 1) to the closed position (shown in FIG. 2). The door 12 is movable between the open and closed positions using a door cylinder 24 having a first end 27 pivotally coupled to the power tong body 10 at a first door cylinder pivot pin 29 and a second end 31 pivotally coupled to the door 12 at a second door cylinder pivot pin 28. The door cylinder 24 may be a hydraulic cylinder or a pneumatic cylinder. The door cylinder 24 may be stroked from the retracted mode shown in FIG. 1 to the extended mode illustrated in FIG. 2 by providing pressurized fluid to the door cylinder 24 to extend the rod 26 from the door cylinder 24 and to impart a moment that pivots the door 12 about the pivot member 14 to the closed position shown in FIG. 2. In one optional embodiment, the door cylinder 24 may include a spring to bias the extendable rod to restore the door cylinder 24 to the retracted position when the door 12 is unlatched and the fluid pressure falls below a predetermined pressure.

FIG. 1 also illustrates a latch post 30 on the power tong body 10. The door 12 includes a well 19 in a static latch member 20 that receives the latch post 30 with the door 12 moved to the closed position. FIG. 1 illustrates a interior bay 11 of the power tong body 10 into which a tubular joint, such as a casing joint, is introduced prior to closure of the door 12 and operation of the latch to secure the door 12 in the closed position. FIG. 1 also shows a pivoting latch member 22 that is pivotable between a retracted position, illustrated in FIG. 1, and an engaged position illustrated in FIG. 3. The pivoting latch member 22 is pivotable about a latch member pivot pin 23 using a latch cylinder 16. The latch cylinder 16 is illustrated in FIG. 1 in the extended mode, with the second end 25 spaced apart from the latch cylinder 16 by the extendable rod 17. The latch cylinder 16 includes a first end 15 that is pivotably coupled to the door 12 at a latch cylinder pivot pin 13, an extendable rod 17 connected to a second end 25 that is pivotably coupled to the latch member 22 at pivotal coupling 18. The latch member 22 can be stroked using the latch cylinder 16 from the retracted position (of FIG. 1), in which the keeper 21 on the latch member 22 is retracted away from the well 19 of the static latch member 20 of the door 12, to the engaged position (of FIG. 3), in which the keeper 21 is pivoted to an engaged position with the latch post 30.

Figure 2:
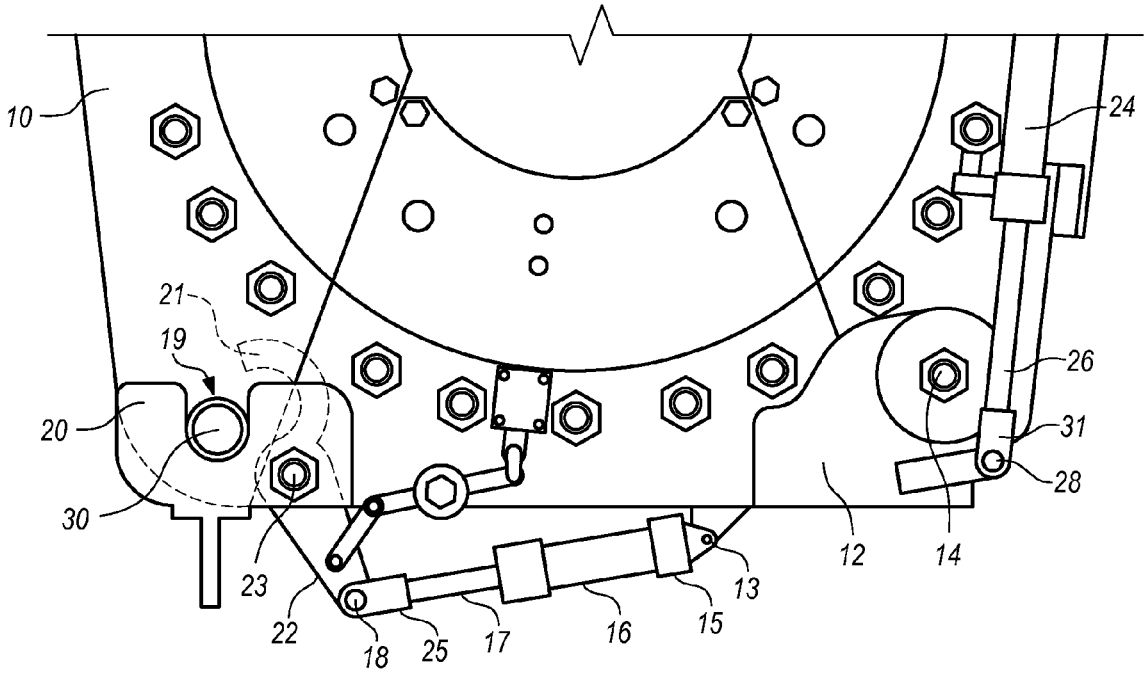
FIG. 2 is the plan view of FIG. 1 after the door is pivoted from the open and unlatched position to the closed and unlatched position.

FIG. 2 is the plan view of FIG. 1 after the door is pivoted from the open position and unlatched position to the closed and unlatched position. FIG. 2 illustrates the door cylinder 24 that is actuated to extend the rod 26 to the extended position to pivot the door 12 about the pivot member 14 (see FIG. 1) to the closed position. It will be noticed that the latch mechanism has not been activated in FIG. 2 and the door 12 is not in the latched position. It will be further understood that the latch cylinder 16 illustrated in FIG. 2 has not been actuated, and the extendable rod 17 remains in the extended mode to dispose the latch member 22 in the retracted position out of engagement with the latch post 30. The latch post 30 is affixed to the power tong body 10 and is shown in FIG. 2 as having been received within the well 19 adjacent to the static latch members 20.

Figure 3:
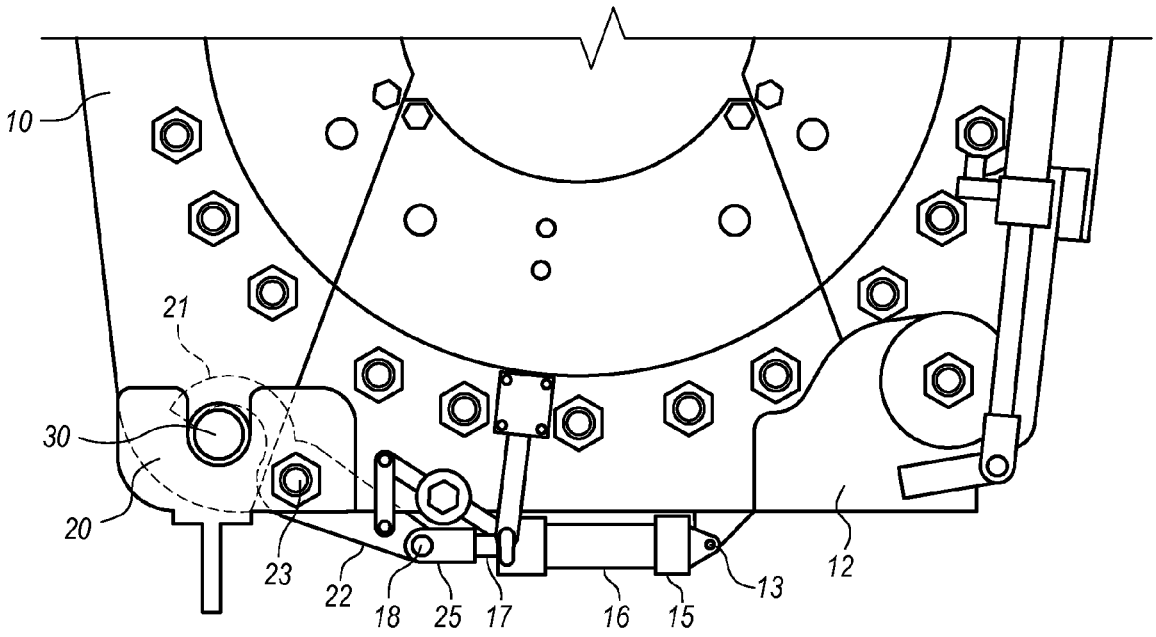
FIG. 3 is a plan view of the power tong body and door of FIG. 2 after the latch member is stroked by actuation of the latch cylinder into the engaged position to secure the door in the closed and latched position.

FIG. 3 is a plan view of the power tong body 10 and door 12 of FIG. 2 after the latch member 22 is stroked by actuation of the latch cylinder 16 into the engaged position to secure the door 12 in the closed and latched position. FIG. 3 illustrates the use of the improved door latch mechanism to secure the door 12 in the closed and latched position. The latch cylinder 16 is actuated to retract the extendable rod 17 to the retracted configuration and to thereby pivot the latch member 22 from the retracted position shown in FIG. 2 to the engaged position shown position shown in FIG. 3. In the engaged position, it can be seen that the keeper 21 of the latch member 22 is engaged with the latch post 30. It will be further noted that the keeper 21 of the latch member 22 engages the latch post 30 in opposition to the static latch members 20 on the door 12. This opposing relationship stabilizes the door 12 in the securely closed position. Maintaining fluid pressure on the latch cylinder 16 to bias the latch cylinder 16 and the latch member 22 coupled thereto to the latched position shown in FIG. 3 will maintain the latch post 30 in a position trapped intermediate the keeper 21 of the latch member 22, on a first side, and the static latch member 20 of the door 12 on the second and opposite side of the latch post 30.

Figure 4:
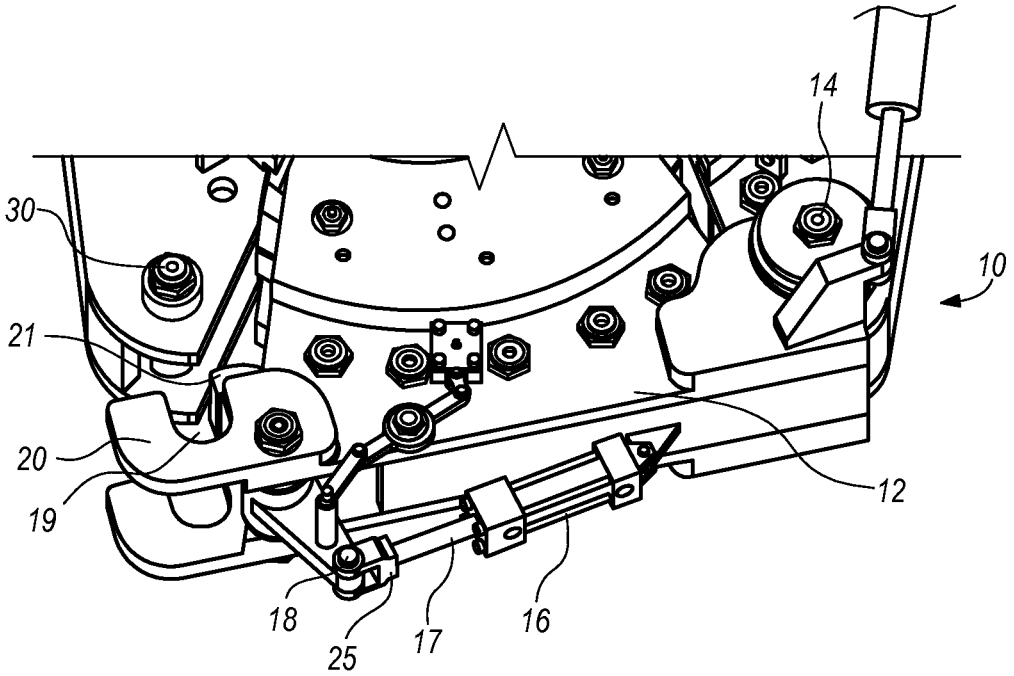
FIG. 4 is a perspective view of the power tong body, the door and the improved latch mechanism of the door in a position between the open position illustrated in FIG. 1 and the closed position illustrated in FIGS. 2 and 3.

FIG. 4 is a perspective view of the power tong body 10, the door 12 and the improved latch mechanism of the door 12 in between the open position illustrated in FIG. 1 and the closed position illustrated in FIGS. 2 and 3. It will be noted that the door cylinder 16 remains in the extended mode with the extendable rod 17 in an extended position to distance the second end 25 from the door cylinder 16 and to position the keeper 21 in the retracted position to allow the latch post 30 to be received into the well 19 of the static latch member 20 of the door 12.

Figure 5:
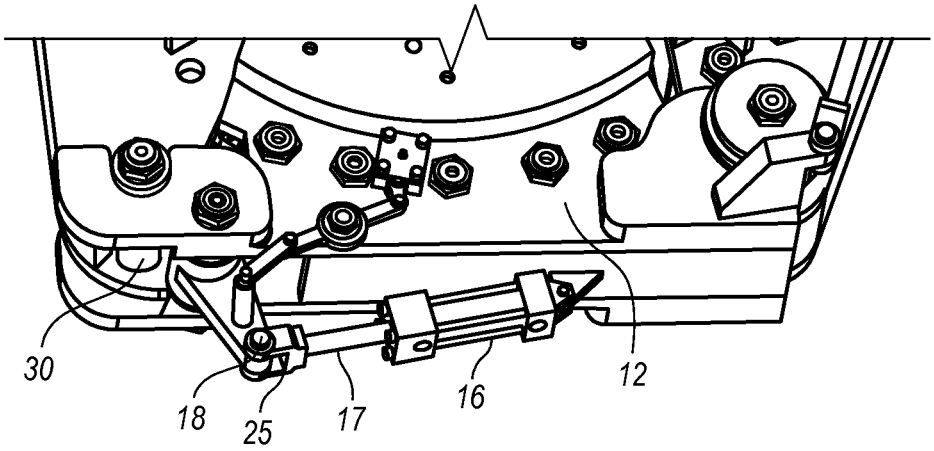
FIG. 5 is the perspective view of the power tong body, the door and the improved latch mechanism of the door of FIG. 4 after the door is pivoted about the pivot member to the closed position and before the improved latch mechanism is used to secure the door in the closed and locked position.

FIG. 5 is the perspective view of the power tong 10, the door 12 and the improved latch mechanism of the door of FIG. 4 after the door 12 is pivoted about the pivot member 14 to the closed position and before the improved latch mechanism is used to secure the door 12 in the closed and locked position.

Figure 6:
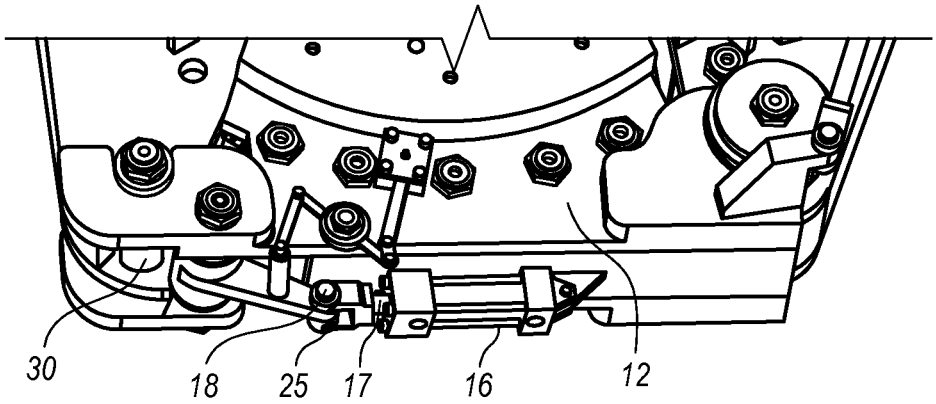
FIG. 6 is the perspective view of the power tong body, the door and the improved latch mechanism of the door of FIG. 5 after the improved latch mechanism is used to secure the door in the closed and locked position.

FIG. 6 is the perspective view of the power tong 10, the door 12 and the improved latch mechanism of the door of FIG. 5 after the improved latch mechanism is used to secure the door 12 in the closed and locked position.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A power tong for making up and breaking out threaded connections between adjacent segments of pipe, comprising:

a body having an interior bay for receiving an end of a pipe segment, a lateral access opening providing lateral access to the interior bay, and a latch post disposed on the body adjacent to a lateral access to the interior bay;

a door having a proximal end pivotally coupled to the body and a distal end having at least one static latch member with a post bay to receive and engage the latch post on the body upon closure of the door across the lateral access opening, the distal end of the door further including at least one pivotal latch member pivotally coupled to the door adjacent to the at least one static latch member, the pivoting latch member having a proximal end and a distal end with a post bay to receive and engage the latch post on the body, the pivoting latch member being pivotally positionable relative to the door between an engaged position, to engage the post bay at the distal end of the at least one pivotal latch member with the latch post to secure the door in a closed position across the lateral opening, and a retracted position to disengage the distal end of the pivotal latch member and the bay from the latch post to release the door from the closed position;

a door cylinder having a chamber with a proximal end coupled to the body and an extendable rod movably received within a bore of the chamber, the extendable rod having a proximal end and a distal end pivotally coupled to the door, the rod being extendable from a distal end of the chamber to move the door from an open position to a closed position to close the lateral access to the interior bay of the body and retractable into the chamber to move the door from the closed position to the opened position removed from the lateral access opening to the interior bay of the body; and a latch cylinder having a chamber with a proximal end pivotally coupled to the door and a rod extendable from the chamber with a distal end coupled to the proximal end of the at least one pivotal latch member, the latch cylinder being extendable to pivot the at least one pivotal latch member to the retracted position and retractable within the chamber to pivot the at least one pivotal latch member to the engaged position wherein the latch post is received into the post bay of the pivotal latch member;

wherein the at least one pivotal latch member, in the engaged position, secures the door in the closed position to close the bay of the body by application of a force against the latch post of the body in opposition to a force imparted to the latch post by the at least one static latch member.

2. The power tong of claim 1, wherein the door cylinder and the latch cylinder are one of hydraulic cylinders and pneumatic cylinders.

3. The power tong of claim 1, wherein the at least one static latch member comprises two static latch members having a gap therebetween.

4. The power tong of claim 3, wherein the at least one pivotal latch member comprises one pivotal latch member; and wherein the one pivotal latch member engages the latch post at a position on the latch post that is aligned with the gap between the two static latch members and intermediate two positions on the latch post engaged by the two static latch members.

5. A power tong for making up and breaking out threaded connections between two adjacent segments of pipe, comprising:

a body having a bay and a latch post secured to the body proximal to an opening to the bay;

a door pivotally coupled at a proximal end to the body and pivotally movable between a closed position, to close the opening of the bay of the body, and an open position, removed from the opening of the bay of the body, and the door further including a distal end with one or more static latch members, each having a bay to engage the latch post of the body; and a latch cylinder with a proximal end pivotally coupled to the body and a rod hydraulically extendable from the distal end of the latch cylinder, the extendable rod having a distal end pivotally coupled to a pivotal latch member on the door adjacent to the one or more static latch members and having a bay to engage the latch post of the body upon pivoting of the pivotal latch member from a retracted position to an engaged position by operation of the latch cylinder.

6. The power tong of claim 5, wherein the pivoting of the pivotal latch member of the door engages the bay of the pivotal latch member with a portion of the latch post that is radially opposite to a section of the latch post engaged by the bay of the one or more static latch members.

7. The power tong of claim 6, wherein the one or more static latch members comprise two static latch members; and wherein the bays of the two latch members on the door are spaced apart by a gap.

8. The power tong of claim 7, wherein in the engaged position the pivotal latch member engages a section of the latch post that is axially intermediate sections of the latch post engaged by the two static latch members and aligned with the gap.

* * * * *